United States Patent [19]

Degner

[11] Patent Number: 4,522,377

[45] Date of Patent: Jun. 11, 1985

[54] METHOD AND APPARATUS FOR PROCESSING SLAG

[75] Inventor: Frederick M. Degner, Waupaca, Wis.

[73] Assignee: The Budd Company, Troy, Mich.

[21] Appl. No.: 533,594

[22] Filed: Sep. 19, 1983

[51] Int. Cl.[3] ..... F27D 3/14

[52] U.S. Cl. ..... 266/196; 65/141; 75/24; 241/67; 266/46; 266/137; 266/227; 266/236

[58] Field of Search ..... 241/67; 65/19, 141; 266/195, 196, 137, 227, 236, 46; 75/24

[56] References Cited

U.S. PATENT DOCUMENTS

| | | | |
|---|---|---|---|
| 505,551 | 9/1893 | Iles . | |
| 1,051,627 | 1/1913 | Passow | 65/41 |
| 2,084,976 | 6/1937 | Puerner | 241/23 |
| 2,139,949 | 12/1938 | Forsythe et al. . | |
| 2,202,706 | 5/1940 | Matela . | |
| 3,171,736 | 3/1965 | Debenham . | |
| 3,316,079 | 4/1979 | Grady . | |
| 3,417,930 | 12/1968 | Brumagin et al. | 241/23 |
| 3,979,108 | 9/1976 | Nagasaki et al. . | |
| 4,050,884 | 9/1977 | Jablin . | |
| 4,177,974 | 12/1979 | Higuchi et al. | 266/196 |
| 4,362,504 | 12/1982 | Kajikawa et al. . | |

*Primary Examiner*—Melvyn J. Andrews
*Attorney, Agent, or Firm*—Harness, Dickey & Pierce

[57] ABSTRACT

Molten slag is poured onto the upper surface of an elongated conveyor member. The surface of the conveyor member is cooled while maintaining it free from contact with liquids. Preferably, this is accomplished by way of a water cooled pan connected to the lower surface of the member. Reciprocal lengthwise motion is imparted to the conveyor member to transport the slag over the cooled surface until the slag is solidified and broken into pieces.

6 Claims, 5 Drawing Figures

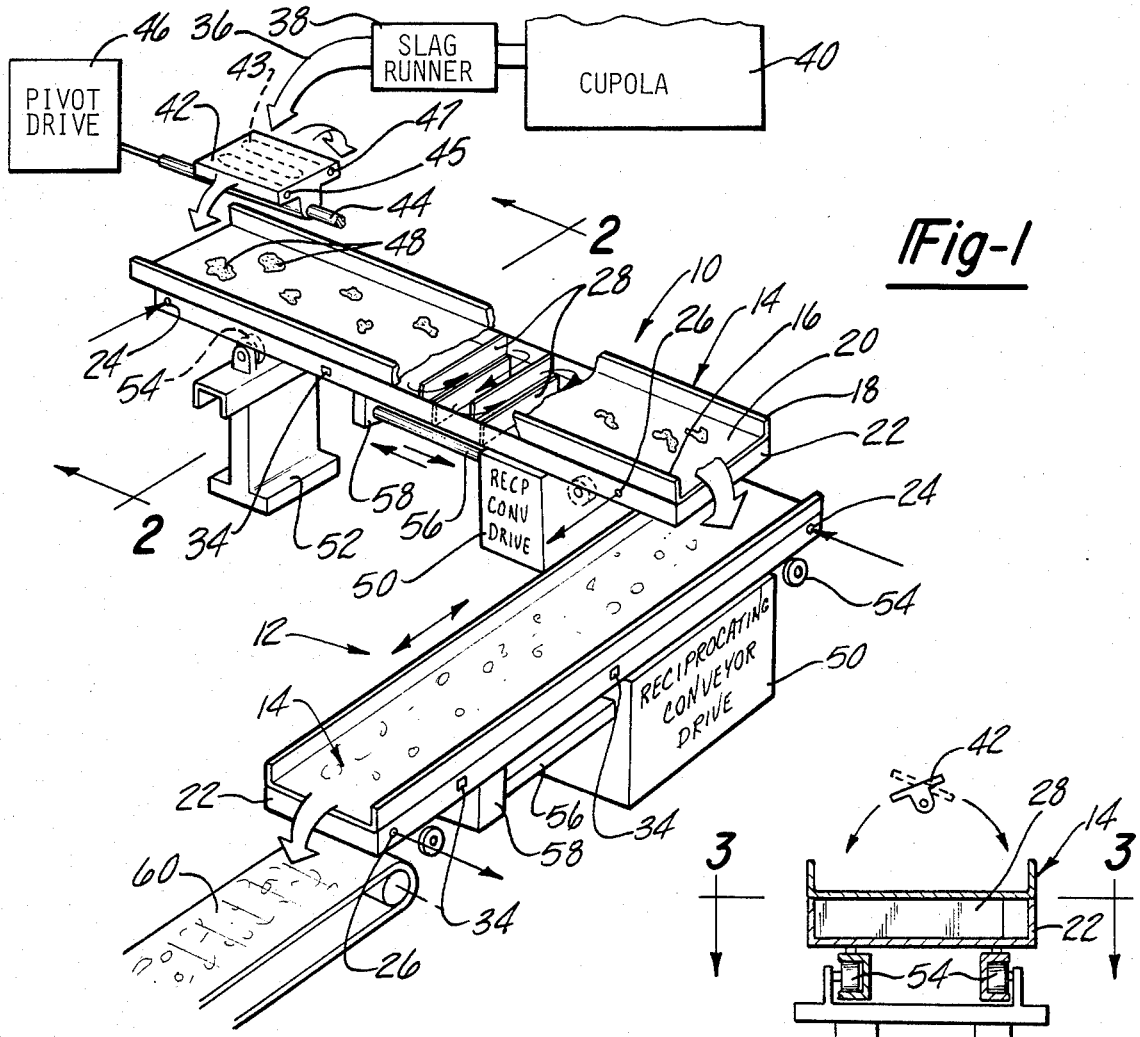
Fig-1
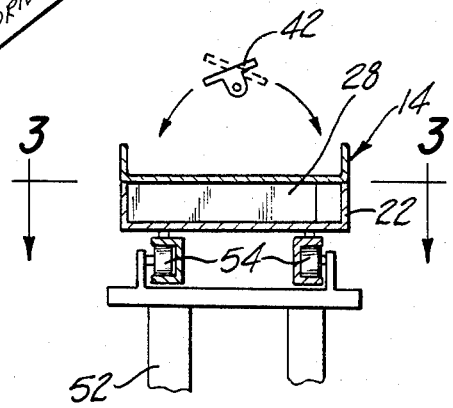
Fig-2
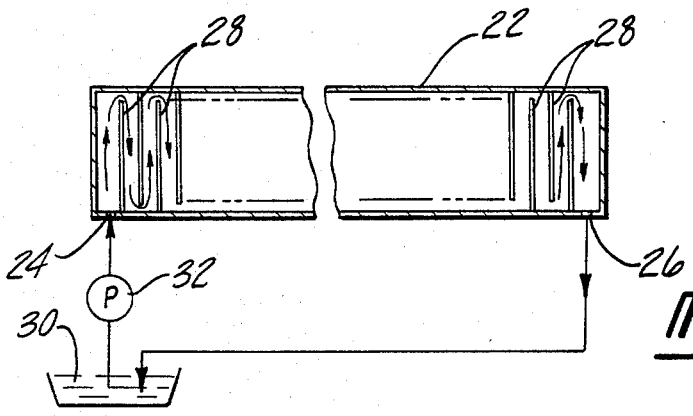
Fig-3
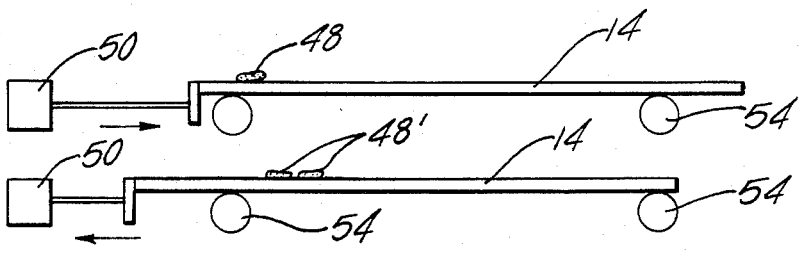
Fig-4A
Fig-4B

METHOD AND APPARATUS FOR PROCESSING SLAG

TECHNICAL FIELD

This invention relates to slag processing systems and, more particularly, to a method and apparatus for cooling the slag without contacting it with water.

BACKGROUND ART

Metallurgical slags are produced in the refining of various metals. These slags are produced in a molten form and must be cooled before they can be disposed. A variety of techniques have been employed in the past to cool the slag. The following U.S. patents form a representative, though not exhaustive, list of various slag processing techniques: U.S. Pat. Nos. 505,551 to Iles; 2,139,949 to Forsythe et al; 3,171,736 to Debenham; 3,136,079 to Grady; 4,362,504 to Kajikawa et al; 4,050,884 to Jablin; 3,979,108 to Nagasaki et al; and 2,202,706 to Matela.

The current practice of many iron and steel foundries is to introduce the molten slag into a granulation box which has a water flow of sufficient volume and turbulence at the point of slag impingement to cool and granulate the slag. The water flow then carries the granulated slag away in a trough for dewatering or other processing that may be desired. Generally, the granulated slag is then collected and transported by truck to a landfill or used as ballast in road building, as concrete aggregate, or in the making of glass fibers and so forth.

Unfortunately, the aforementioned technique, as well as other processes where the slag directly contacts the water, has one or more of the following problems. The chunks of cooled slag produced by these processes are relatively large and characterized by a low density mass thereby contributing to high trucking costs. The low density of the granulated slag also may lead to premature landfill aging and may limit the use of the slag in applications where more dense, smaller and less abrasive slag particles are desirable. The granulated slag also tends to cause excessive wear on the pumps and pipes used to transport the mixture for dewatering. Separating the water from the granulated slag is a relatively difficult process. Using conventional techniques where the slag is skimmed from the dewatering tank there still remains a considerable amount of water in the slag which is susceptible to freezing and other problems in cold weather. Settling ponds used in such systems must be dredged periodically to remove the settled solids and the amount of water usage necessary for employing this approach is very high. Moreover, since the cooling and transfer water directly contacts the slag, the water must be treated before it can be safely discharged from the plant.

Those persons knowledgable in the art are undoubtedly aware of other problems that are created by conventionally used slag processing systems.

SUMMARY OF THE INVENTION

Pursuant to the present invention, molten slag is processed into a compact and dense shape without directly contacting water or other source of coolant fluid. Instead, the molten slag is poured onto a generally flat upper surface of an elongated conveyor member. The upper surface of the conveyor member is cooled while maintaining it free from contact with any liquids. Means are provided for transporting the slag over the cooled surface until the molten slag is solidified and broken into pieces, preferably by imparting reciprocal lengthwise motion to the conveyor member.

In the preferred embodiment, a water cooled pan is connected to the lower surface of a metal trough. The pan includes a plurality of baffles therein for causing cooling liquid to flow in a serpentine pattern along the path of movement of the slag in the trough. In such manner the water flow is evenly distributed thereby preventing so-called hot spots from developing on the trough surface over which the slag is transported. Means are also preferably provided for diverting the poured molten slag to different locations on the conveyor member. In the preferred embodiment, the molten slag is deposited on a water cooled pivot plate which alternately diverts the slag to opposite sides of the trough.

The use of the present invention results in the production of a denser, less abrasive end product while requiring a reduced amount of cooling water that does not come into direct contact with the slag. As a result, the aforementioned problems associated with the prior art approach have been substantially eliminated.

BRIEF DESCRIPTION OF THE DRAWINGS

Still other advantages of the present invention will become apparent to those skilled in the art after reading the following specification and by reference to the drawings in which:

FIG. 1 is a perspective view with parts cut away of the apparatus of the preferred embodiment of this invention;

FIG. 2 is a partial cross sectional view taken along the lines 2—2 of FIG. 1;

FIG. 3 is a view taken along the lines 3—3 of FIG. 2; and

FIG. 4(A–B) are diagramatic views illustrating, in simplified form, the conveying action utilized in the preferred embodiment of this invention.

DESCRIPTION OF THE PREFERRED EMBODIMENT

In FIG. 1 there is shown two conveyors 10 and 12 for transporting and cooling metalurgical molten slag. Conveyors 10 and 12 are substantially identical and thus, a description of one of them shall suffice. Each conveyor includes an upper elongated metal trough 14 having a pair of upstanding side walls 16 and 18 and a generally flat bottom 20. By way of a nonlimiting example, trough 14 is about 14 feet in length and approximately two feet wide.

A water cooled pan 22 is attached to the underside of trough 14 and runs substantially the entire length thereof. Pan 22 includes a water inlet 24 in one end thereof and an outlet 26 in an opposite end. A series of interdigitated baffles 28 extend substantially normal to the length of pan 22. As can be seen most clearly in FIGS. 2 and 3, the baffles are approximately the same height as pan 22 and their ends are alternately connected to the sides of the pan 22 so as to cause the water to flow in a serpentine pattern from inlet 24 to outlet 26. Again, by way of a nonlimiting example, the baffles 28 are spaced about $1\frac{3}{8}$ to $1\frac{5}{8}$ inch apart, they are about $\frac{1}{2}$ inch in height and they include a spacing of about $1\frac{1}{2}$ inch at their ends to allow passage for the water to flow around their ends.

As shown in FIG. 3 the inlet 24 and outlet 26 may be connected to a recirculating water supply including a reservoir 30 and pump 32. Such an arrangement would have the advantage of keeping the total amount of water usage to a minimum. However, the use of non-recirculating water delivered from a municipality water facility has provided satisfactory results. The water flow in pan 22 is for the purpose of cooling trough 14 and the baffles are designed to promote even cooling throughout the bottom 20 of the trough thereby eliminating so called "hot spots". The water temperature is kept as low as possible (for example, an inlet water temperature of about 60 degrees F. is acceptable) and the water circulation is maintained in pan 22 so as to avoid the creation of steam. However, several pressure relief valves 34 may be provided in pan 22 to relieve undue pressure build up.

The primary design constraint on water pan 22, or any similar means, is to cool the trough without contacting the upper surface of trough 14 with water or other cooling liquid. In other words, direct water contact with the slag on trough 14 is to be avoided.

The molten metallurgical slag is generally designated by the arrow 36 in FIG. 1. The molten slag may conventionally be delivered by way of a slag runner 38 communicating with a furnace or cupola 40. In the preferred embodiment the molten slag is poured onto the upper surface of a water cooled pivot plate 42. Pivot plate 42 pivots about an axis 44 running generally parallel to the length of conveyor 10. As the metallurgical slag 36 is poured onto plate 42 a pivot drive 46 operates to tilt the plate to one side and then the other so as to alternately deposit puddles or sheets 48 of slag on alternate sides of trough 14. The purpose of pivot plate 42 is to provide discontinuities in the flow of the metallurgical slag on conveyor 10. While the size of the slag sheets 48 may vary, satisfactory results have been achieved with diameters in the neighborhood of about ten inches. Plate 42 may be cooled by a variety of means such as an internal passageway 43 through which water is circulated from an inlet 45 to an outlet 47. Cooling of plate 42 prevents the slag 36 from sticking to the plate and also acts to prevent warpage and the possibility of burning a hole through the metal plate by the hot slag.

The molten slag typically is heated to a temperature of about 2,400–2,800 degrees Farenheit. However, when the molten slag hits the cooled conveyor surface it begins to solidify. The cooling action is continued as the sheets are conveyed towards the discharge end of conveyor 10. In the preferred embodiment, the water cooled trough 14 is reciprocated lengthwise by a conveyor drive mechanism 50. Conveyor drive 50 is designed so as to accelerate water cooled trough 14 in a forward direction for a given period of time and then to move the trough 14 in a reverse direction with a considerably higher acceleration.

Reference to FIG. 4 will aid in the understanding of this type of conveying action. FIG. 4A shows the trough 14 being moved forwardly with a given acceleration while in FIG. 4B trough 14 is pulled back with a higher acceleration thereby imparting net forward movement of the slag sheet 48 towards the discharge end of the conveyor. Transportation of the slag with this type of conveying action tends to break the sheets into smaller, less abrasive particles as designated by the numeral 48′ in FIG. 4B. Conveyor systems of this general type are known in the art and are commercially available under the trademark FLAT-STROKE conveyor systems from Goodman Equipment Corporation of Chicago, Ill. Briefly, conveyors 10 and 12 are disposed in a generally horizontal manner on supports 52 and the water cooled trough 14 rides on rollers 54. The drive mechanism 50 is connected to the water cooled trough by way of an arm 56 connected to a cross member 58.

This type of conveying action is preferred because there is little vibration created thereby maintaining the slag sheets in contact with the cooled trough surface as much as possible. The minimal vibration is also advantageous since it does not disturb the refractory lining of the cupola 40 in the foundry.

As the slag sheets are transported down the conveyor, they tend to fracture and break up into small pieces. In the embodiment shown in FIG. 1, a second conveyor 12 is disposed beneath the discharge end of conveyor 10. Consequently, the slag sheets drop onto the hard trough of conveyor 12 thereby even further contributing to the fracturing of the slag sheets. However, the use of a second conveyor should be considered as optional to the broad teachings of this invention where sufficient cooling of the slag can be accomplished by one conveyor.

After the slag sheets are transported down conveyor 12, they are dropped onto a conventional belt conveyor 60 where they can be transported conveniently to a receptacle for collection. The fractured slag fragments are characterized by a denser, less abrasive product than slag made by conventional prior art approaches. More importantly, since the slag is cooled and broken into pieces without contacting the water, all of the aforementioned problems associated with direct water cooling of the slag have been substantially eliminated. Various other advantages and modifications of the preferred embodiment will become apparent to those skilled in the art after a study of the specification, drawings and the following claims.

I claim:

1. Apparatus for processing a stream of molten slag, said apparatus comprising:

an elongated conveyor member having a generally flat major upper surface;

cooling means for cooling the upper surface of the member;

means for diverting the stream of molten slag onto different locations on the upper surface of the conveyor member; and means connected to the conveyor member for imparting reciprocal lengthwise motion to the conveyor member substantially free of vertical motion thereto to thereby transport the slag over the cooled surface until the molten slag is solidified.

2. The apparatus of claim 1 wherein said cooling means includes:

a pan connected to the lower surface of the conveyor member, and means for circulating water through the pan.

3. The apparatus of claim 2 wherein said pan includes:

a series of baffles disposed generally normal to the length of the conveyor member and adapted to cause the water to flow in a serpentine pattern from an inlet near one end of the conveyor member to an outlet near a discharge end thereof.

4. The apparatus of claim 1 wherein said diverting means includes a water cooled plate pivoting about an axis extending generally parallel to the length of the conveyor member and adapted to alternately divert molten slag to opposite sides of the upper surface of said conveyor member.

5. The apparatus of claim 1 which further comprises:

second conveyor means located beneath a discharge end of said conveyor member whereby the slag is dropped onto the second conveyor means to further break the slag into pieces.

6. Apparatus for processing molten slag, said apparatus comprising:

an elongated conveyor member in the form of a trough having a generally flat upper major surface made of thermally conductive material and side walls extending along the length thereof;

a pan connected to the underside of the conveyor member and running substantially the entire length thereof, said pan including an inlet near one end of the conveyor member and an outlet near a discharge end of the conveyor member, means for circulating water between said inlet and outlet, and said pan including a series of baffles therein disposed generally normal to the length of the conveyor and adapted to cause the water to flow in a serpentine pattern from the inlet to the outlet for evenly cooling said conveyor member;

a pivot plate located above the conveyor member near said one end, means for pivoting said plate about an axis extending generally parallel to the length of the conveyor, and means formed internally in the plate through which circulating cooling fluid can flow;

means for depositing molten slag onto the pivot plate, with the plate alternately diverting the molten slag to opposite sides of the conveyor member surface; and means connected to the conveyor member for imparting reciprocal lengthwise motion thereto in which acceleration of the conveyor member in the direction of said one end is greater than that in the direction of the discharge end whereby the molten slag is transported over the cooled conveyor member surface until the slag solidifies.

* * * * *